US005263347A

United States Patent [19]

Allbaugh et al.

[11] Patent Number: 5,263,347

[45] Date of Patent: Nov. 23, 1993

[54] REMOTE CONTROL DEADLOCK BOLT FOR CARS

[76] Inventors: Mark E. Allbaugh, 30 Lake St. #10E, White Plains, N.Y. 10603; George Spector, 233 Broadway Rm 702, New York, N.Y. 10279

[21] Appl. No.: 947,487

[22] Filed: Sep. 21, 1992

[51] Int. Cl.[5] ..... E05B 65/22

[52] U.S. Cl. ..... 70/257; 70/153; 70/280; 70/468; 292/144; 292/DIG. 23; 292/DIG. 25

[58] Field of Search ..... 70/256, 257, 277, 280, 70/283, 467, 468, 489, 153; 292/144, 254, DIG. 23, DIG. 25

[56] References Cited

U.S. PATENT DOCUMENTS

| | | | |
|---|---|---|---|
| 2,785,916 | 3/1957 | Mutti | 292/144 |
| 3,830,332 | 8/1974 | Fontaine | 70/257 X |
| 4,143,368 | 3/1979 | Route et al. | 340/426 X |
| 4,683,737 | 8/1987 | Armstrong | 70/256 X |
| 4,782,674 | 11/1988 | Johnson | 292/DIG. 36 X |
| 4,866,963 | 9/1989 | Leininger et al. | 70/256 X |
| 5,109,221 | 4/1992 | Lambropoulos et al. | 340/825.31 X |
| 5,113,182 | 5/1992 | Suman et al. | 340/825.31 |

*Primary Examiner*—Lloyd A. Gall

[57] ABSTRACT

A remote control locking device is provided for a door of a motor vehicle, which consists of a remote transmitter outside of the motor vehicle for transmitting a radio signal. A receiver is carried within and is electrically connected to the electrical system of the motor vehicle for receiving the radio signal from the remote transmitter. A piston is electrically connected to the receiver and is mounted within a door jamb of the motor vehicle adjacent the side of the door. A dead bolt plunger is axially aligned with and projects outwardly from the piston for a relative lineal movement between extended and retracted positions upon operation of the remote transmitter, so that the dead bolt plunger can engage with the side to lock the door and disengage from the side to unlock the door.

2 Claims, 2 Drawing Sheets

REMOTE CONTROL DEADLOCK BOLT FOR CARS

BACKGROUND OF THE INVENTION

The instant invention relates generally to door locks and more specifically it relates to a remote control locking device for a door of a motor vehicle, which provides a dead bolt mechanism housed within the motor vehicle body operable from a remote location.

There are available various conventional door locks which do not provide the novel improvements of the invention herein disclosed.

SUMMARY OF THE INVENTION

A primary object of the present invention is to provide a remote control locking device for a door of a motor vehicle that will overcome the shortcomings of the prior art devices.

Another object is to provide a remote control locking device for a door of a motor vehicle, which is housed within the body of the motor vehicle and is operable from a remote location from the exterior of the motor vehicle, so as to prevent an unauthorized person from entering the motor vehicle.

An additional object is to provide a remote control locking device for a door of a motor vehicle, in which the dead bolt of the locking device will prevent the door from opening, as well as keeping the door opening mechanism from operating.

A further object is to provide a remote control locking device for a door of a motor vehicle that is simple and easy to use.

A still further object is to provide a remote control locking device for a door of a motor vehicle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
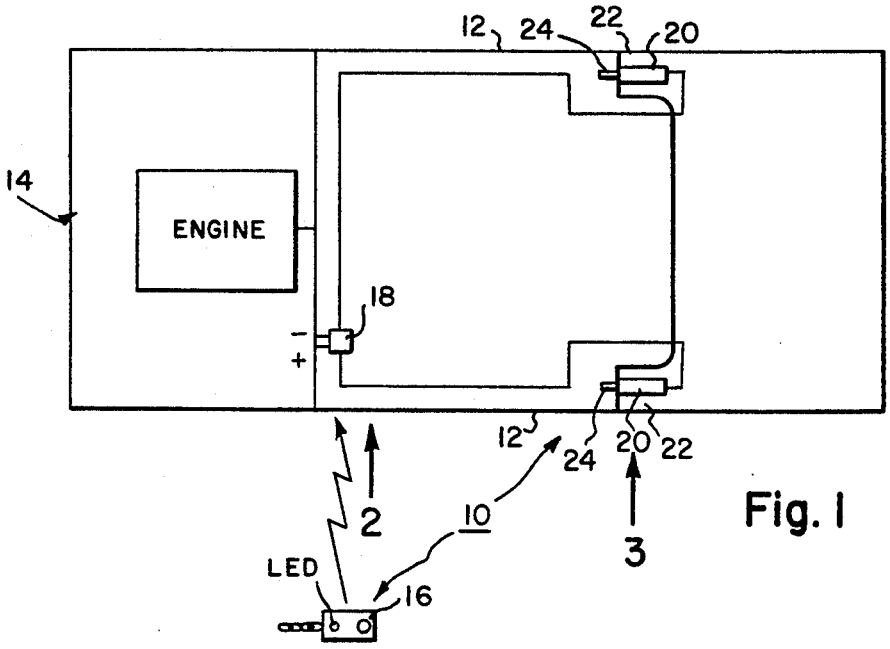
FIG. 1 is a diagrammatic top sectional view of a motor vehicle with the instant invention installed therein.
Figure 2:
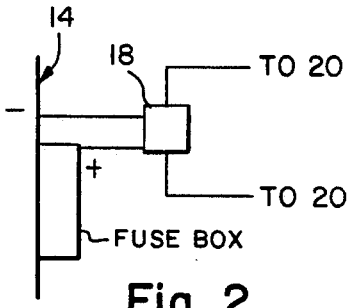
FIG. 2 is a diagrammatic side internal view taken in direction of arrow 2 in FIG. 1, showing the RF controlling receiver device.

Turning now descriptively to the drawings, in which similar reference characters denote similar elements throughout the several views, the Figures illustrate a remote control locking device 10 for a door 12 of a motor vehicle 14, which consists of a remote transmitter 16, outside of the motor vehicle 14, for transmitting a radio signal. A receiver 18 is carried within and is electrically connected to the electrical system of the motor vehicle 14, for receiving the radio signal from the remote transmitter 16. A piston 20 is electrically connected to the receiver 18 and is mounted within a door jamb 22 of the motor vehicle 14 adjacent the side 23 of the door 12. A dead bolt plunger 24 is axially aligned with and projects outwardly from the piston 20 for a relative lineal movement between extended and retracted positions upon operation of the remote transmitter 16, so that the dead bolt plunger 24 can engage with the side 23 to lock the door 12 and disengage from the side 23 of the door 12.

Figure 3:
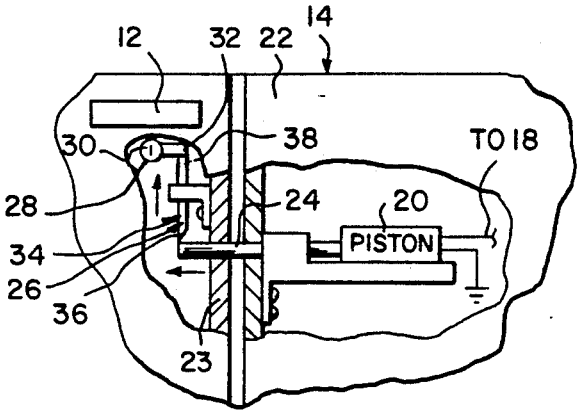
FIG. 3 is a diagrammatic side view with parts broken away of a first modification taken in direction of arrow 3 in FIG. 1, showing the piston with the dead bolt therein, which when activated prevents the door lock cylinder from operating.

The remote control locking device 10, further includes a mechanism 26 for simultaneously immobilizing the door opening mechanism 28 of the door 12 of the motor vehicle 14. The immobilizing mechanism 26, shown in FIG. 3, contains the door opening mechanism 28 being a key operated door lock cylinder 30 in the door 12, having a tab 32 projecting from the side. A vertical rod 34 is mounted within the side 23 of the door 12, to slide therein. The vertical rod 34 has a lower beveled end 36 to contact the distal end of the dead bolt plunger 24. When the dead bolt plunger 24 is in its extended position, the vertical rod 34 will slide upward with an upper end 38 of the vertical rod 34 engaging the tab 32, preventing the door lock cylinder 30 from turning.

Figure 6:
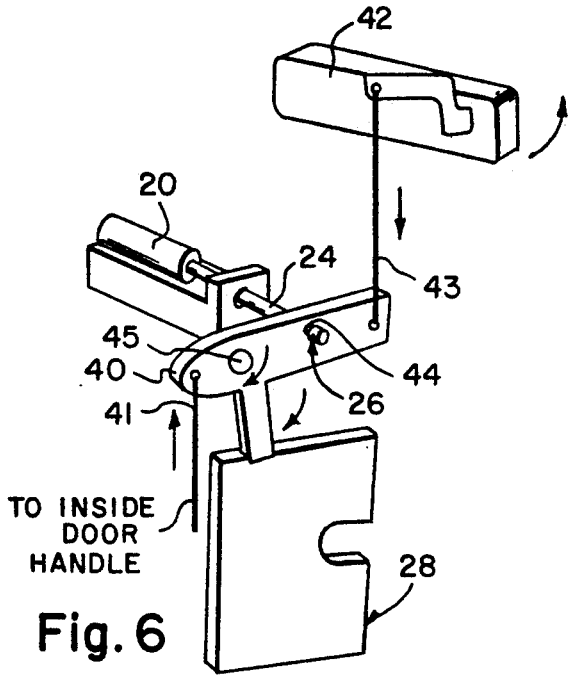
FIG. 6 is a diagrammatic perspective view taken in direction of arrow 6 in FIG. 5 of the internal door opening mechanism showing the reversing piston with the dead bolt, which when activated prevents the door opening mechanism from operating.
Figure 7:
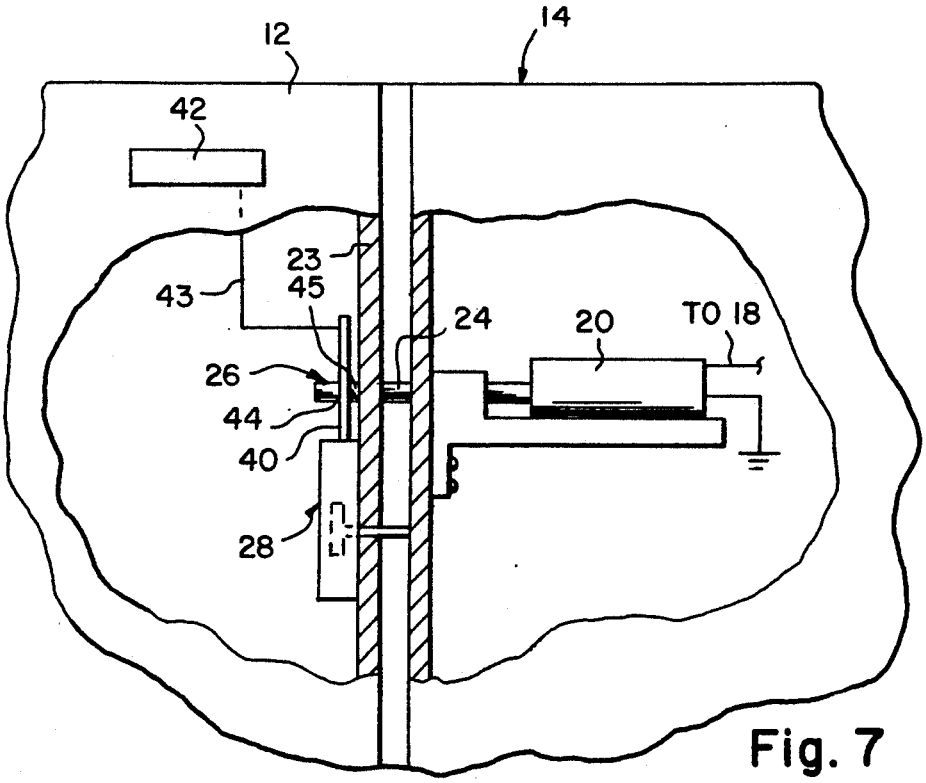
FIG. 7 is a diagrammatic side view with parts broken away taken in direction of arrow 7 in FIG. 5.

The immobilizing mechanism 28, shown in FIG. 6 and 7, consists of the door opening mechanism 28 containing a main linkage lever 40 coupled by rigid links 41 and 43 between an inside door handle (not shown) and an outside door handle 42. Whereby links 41 and 43 either locks or releases the door handles. The main linkage lever 40 is pivoted at 45 to the side 23 of the door 12 and has an aperture 44 therethrough, so that when the dead bolt plunger 24 is in its extended position its distal end will enter the aperture 44 in the main linkage lever 40, to prevent operation of lever 40 and the door handles. The connection between link 43 and door handle 42 is shown schematically.

Figure 4:
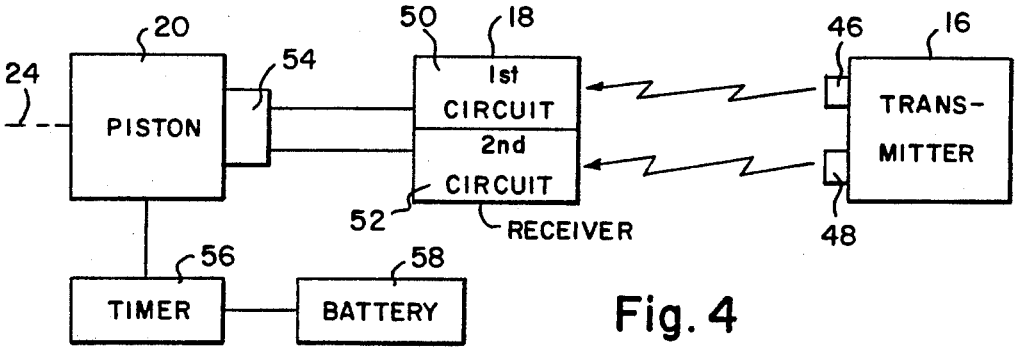
FIG. 4 is a block diagram showing a different type of electrical circuit that can be utilized.
Figure 5:
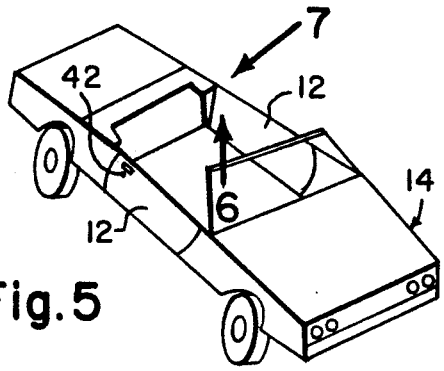
FIG. 5 is a perspective view of a motor vehicle with a second modification of the instant invention installed therein.

The remote transmitter 16, shown in FIG. 4, has a first radio signal sending circuit control button 46 and a second radio signal sending circuit control button 48. The receiver 18 has a first radio signal receiving circuit 50 and a second radio signal receiving circuit 52. The piston 20 has a reversing switch 54 coupled thereto, in which the first radio signal receiving circuit 5 and the second radio signal receiving circuit 52 are each electrically connected to the reversing switch 54. When the first button 46 is pressed in the remote transmitter 16, the dead bolt plunger 24 will go into its extended position to lock the door 12. When the second button 48 is pressed in the remote transmitter 16, the dead bolt plunger 24 will go into its retracted position to unlock the door 12. A timer 56 is electrically connected between the piston 2 and the battery 58 of the motor vehicle 14 to electrically shut down the piston 20 after a predetermined time interval.

While certain novel features of this invention have been shown and described and are pointed out in the annexed claims, it will be understood that various omissions, substitutions and changes in the forms and details of the device illustrated and in its operation can be made by those skilled in the ar without departing from the spirit of the invention.

What is claimed is:

1. A remote control locking device for a door of a motor vehicle which comprises:

a) a remote transmitter outside of the motor vehicle for transmitting a radio signal;

b) a receiver carried within and electrically connected to an electrical system of the motor vehicle for receiving the radio signal from said remote transmitter;

c) a piston electrically connected to said receiver and mounted within a door jamb of the motor vehicle adjacent a side of the door;

d) a dead bolt plunger axially aligned with and projecting outwardly from said piston for a relative lineal movement between extended and retracted positions upon operating of said remote transmitter, so that said dead bolt plunger can engage with the side to lock the door and disengage from the side to unlock the door; further including immobilizing means for simultaneously immobilizing a door opening mechanism of the door of the motor vehicle; wherein said immobilizing means includes:

e) the door opening mechanism being a key operated door lock cylinder in the door, having a tab projecting from its side; and f) a vertical rod mounted within the side of the door to slide therein, said vertical rod having a lower beveled end to contact the distal end of said dead bolt plunger, so that when said dead bolt plunger is in its extended position, said vertical rod will slide upward with an upper end of said vertical rod engaging said tab preventing the door lock cylinder from turning.

2. A remote control locking device for a door of a motor vehicle which comprises:

a) a remote transmitter outside of the motor vehicle for transmitting a radio signal;

b) a receiver carried within and electrically connected to an electrical system of the motor vehicle for receiving the radio signal from said remote transmitter;

c) a piston electrically connected to said receiver and mounted within a door jamb of the motor vehicle adjacent a side of the door;

d) a dead bolt plunger axially aligned with and projecting outwardly from said piston for a relative lineal movement between extended and retracted positions upon operating of said remote transmitter, so that said dead bolt plunger can engage with the side to lock the door and disengage from the side to unlock the door; further including immobilizing means for simultaneously immobilizing a door opening mechanism of the door of the motor vehicle; wherein said immobilizing means includes:

the door opening mechanism containing a main linkage lever coupled by rigid links between an inside door handle and an outside door handle in which the main linkage lever is pivoted to the side of the door and has an aperture therethrough, so that when said dead bolt plunger is in its extended position its distal end will enter the structure in the main linkage lever to prevent pivoting of said lever and operation of said door handles.

* * * * *